United States Patent [19]

Kobayashi et al.

[11] Patent Number: 4,575,320

[45] Date of Patent: Mar. 11, 1986

[54] SCROLL COMPRESSOR HAVING IMPROVED LUBRICATING STRUCTURE

[75] Inventors: Norihide Kobayashi; Toshiyuki Nakamura; Masahiro Sugihara, all of Wakayama, Japan

[73] Assignee: Mitsubishi Denki Kabushiki Kaisha, Tokyo, Japan

[21] Appl. No.: 659,926

[22] Filed: Oct. 11, 1984

[30] Foreign Application Priority Data

Mar. 13, 1984 [JP] Japan ..... 59-49705

[51] Int. Cl.[4] ..... F04C 18/04; F04C 29/02

[52] U.S. Cl. ..... 418/55; 418/94

[58] Field of Search ..... 418/55, 94, 98; 417/372, 902

[56] References Cited

U.S. PATENT DOCUMENTS

| | | | |
|---|---|---|---|
| 2,100,799 | 11/1937 | Drysdale | 417/902 X |
| 4,365,941 | 12/1982 | Tojo et al. | 418/55 X |
| 4,403,927 | 9/1983 | Butterworth et al. | 418/88 X |

FOREIGN PATENT DOCUMENTS

| | | | |
|---|---|---|---|
| 55-64181 | 5/1980 | Japan | 418/55 |
| 804154 | 11/1958 | United Kingdom | 417/902 |
| 2132275 | 7/1984 | United Kingdom | 417/55 |

*Primary Examiner*—John J. Vrablik
*Assistant Examiner*—Theodore W. Olds
*Attorney, Agent, or Firm*—Sughrue, Mion, Zinn, Macpeak and Seas

[57] ABSTRACT

A scroll compressor having an improved lubricating structure so that lubricating oil is supplied substantially instantaneously after the compressor is started to bearings and other sliding members. An oil storage section is formed by a hole in an upper end portion of the main drive shaft and a communicating hole in a drive shaft of the orbiting scroll. A lubricating hole extending longitudinally through the main shaft communicates with the oil storage section via a pipe of a determined height so that lubricating oil is pooled in the oil storage section when the compressor is stopped.

24 Claims, 7 Drawing Figures

SCROLL COMPRESSOR HAVING IMPROVED LUBRICATING STRUCTURE

BACKGROUND OF THE INVENTION

The present invention relates to a lubricating structure in a scroll compressor such as may be used for an air conditioning unit or low-temperature refrigerating unit.

Prior to describing the invention, the principles of a scroll-type fluid machine will be described briefly.

FIGS. 1A to 1D show the fundamental components of a scroll-type fluid machine used as a compressor and illustrate the operating principles thereof. In FIG. 1, reference numeral 1 designates a stationary scroll; 2, an orbiting scroll; 3, an intake chamber; 4, a discharge port; and 5, compression chambers. Further in FIG. 1, reference character O designates the center of the stationary scroll 1.

The stationary scroll 1 and the orbiting scroll 2 have spiral wraps 1*a* and 2*a* which have the same configuration but are wound in opposite directions; that is, they are complementary in configuration. As is well known in the art, the shape of the spiral wraps 1*a* and 2*a* is that of an involute curve or arc.

The operation of this scroll compressor will be described. The stationary scroll 1 is held stationary relative to the frame of the machine. The orbiting scroll 2 is combined with the stationary scroll 1 in such a manner that the phase of the former is shifted by 180° from that of the latter. The center of the orbiting scroll 2 moves around the center O of the stationary scroll 1 without the wrap of the orbiting scroll rotating. Relative positions of the stationary scroll 1 and the stationary scroll 2 at orbiting angles of 0°, 90°, 180° and 270° are indicated in FIGS. 1A to 1D, respectively. When the orbiting scroll 2 is at the 0° position as shown in FIG. 1A, the gas to be compressed is allowed to enter the compression chambers 5 formed between the wraps 1*a* and 2*a*. As the orbiting scroll 2 moves, the volumes of the compression chambers 5 are reduced so that the gas contained therein is compressed and finally discharged through the discharge port 4 provided near the center of the stationary scroll 1.

FIG. 2 shows an example of a scroll compressor such as may be used as a refrigerant compressor. In FIG. 2, reference numeral 1 designates a stationary scroll having a wrap 1*a* formed on one side of a base plate 1*b*; 2, an orbiting scroll having a wrap 2*a* on one side of a base plate 2*b*; 3, a suction inlet of a suction chamber; 4, a discharge port; 5, compression chambers formed between the wraps 1*a* and 2*a* when the wraps 1*a* and 2*a* are combined together; 6, a main shaft; 7, an oil cap having a suction hole 7*a* and which is mounted on the main shaft in such a manner that it covers the lower end of the main shaft with a certain clearance between the lower end of the main shaft and the oil cap; 8 and 9, bearing frames; 10, an electric motor rotor; 11, a motor stator; 12, a housing; 13, an Oldhams coupling; 14, a baffle plate; 15, an oil pool at the bottom of the housing 12; 16, a suction pipe; 17, a discharge pipe; and 18, an orbiting scroll bearing rotatably mounted on an orbiting scroll shaft 2*c* fixed to the side of the base plate 2*b* opposite the wrap 2*a* and located eccentrically with respect to the main shaft 6. The orbiting scroll bearing 8 is fitted in an eccentric hole 60*a* in a large-diameter part 6*a* forming the upper end portion of the main shaft 6.

Further in FIG. 2, reference numeral 19 designates a first main shaft bearing supporting the cylindrical wall 61*a* of the large-diameter part 6*a* of the main shaft 6; 20, a second main shaft bearing supporting a small-diameter part 6*b* forming the lower end portion of the main shaft 6; 21, a first thrust bearing supporting the lower surface 20*b* of the base plate 2*b* of the orbiting scroll 2 in the axial direction; 22, a second thrust bearing supporting, in the axial direction, a step 6*c* formed between the large-diameter part 6*a* and the small-diameter part 6*b* of the main shaft; 23, a lubrication hole formed in the main shaft eccentrically with respect to the central longitudinal axis of the main shaft, the lubrication hole 23 having an opening 23*a* in the lower end of the main shaft 6 and communicating with the bearings 18 and 20; 24, a vent hole formed in the main shaft 6; 25 and 26, oil return holes in oil passages; and 27 and 28, communicating holes in the inlet gas passages.

With the orbiting scroll 2 combined with the stationary scroll 1, the orbiting scroll shaft 2*c* is engaged with the main shaft 6 through the orbiting scroll bearing 18, and the orbiting scroll 2 is supported by the orbiting scroll bearing 18 and the first thrust bearing 21 of the bearing frame 8. The main shaft 6 is supported by the first main shaft bearing 19, the second main shaft bearing 20, and the second thrust bearing 22 which are arranged in the bearing frames 8 and 9 which are coupled to each other, for instance, through a faucet-type joint.

The Oldhams coupling 13 is provided between the orbiting scroll 2 and the bearing frame 8 in order to prevent rotation of the wrap of the orbiting scroll 2 and to allow only the orbiting movement of the scroll 2. The stationary scroll 1, together with the bearing frames 8 and 9, is secured with bolts. The motor rotor 10 is fixedly mounted on the main shaft 6 by press fitting, shrink fitting or with screws, and the motor stator 11 is fixedly secured to the bearing frame 9 in the same manner. The oil cap 7 is fixed to the main shaft 6 by press fitting or shrink fitting. The assembly thus formed is mounted in the housing 12 with the scrolls 1 and 2 at the top and the motor rotor 10 and the motor stator 11 at the bottom.

The operation of the scroll compressor thus constructed will be described.

When the motor rotor 10 rotates, the orbiting scroll 2 is moved through the main shaft 6 and the Oldhams coupling 13, and compression in accordance with the operating principle described with reference to FIG. 1 starts. Thereupon, refrigerant gas is sucked through the inlet pipe 16 into the housing 12. This gas, as indicated by the solid-line arrows, passes through the communicating hole 27 between the bearing frame 9 and the motor stator 11 and through the air gap between the motor rotor 10 and the motor stator 11 to cool the motor, and then passes through the communicating hole 28 between the housing 12 and the bearing frames 8 and 9 and is delivered through inlet 3 of the stationary scroll 1 to the compression chambers 5 where it is compressed. The gas thus compressed is discharged through the discharge port 4 and the discharge pipe 17.

Lubricating oil from the oil pool 15 is supplied to the bearings 18 and 20 through the suction hole 7*a* of the oil cap 7 and the lubrication hole 23 in the main shaft, and to the bearings 21, 19 and 22 from the bearing 18, in the stated order, by the centrifugal pumping action caused by the oil cap 7 on the main shaft 6 and the lubrication hole 23, as indicated by the broken-line arrows. The oil once used for lubrication is returned to the oil pool 15 through the oil return holes 25 and 26 in the bearing frames 8 and 9.

The baffle board 14 is provided to close the gap between the bearing frame 8 and the peripheral surface of the orbiting scroll 2 so that oil which has leaked through the bearing 21, etc. will not be sucked directly into the suction inlet 3. The baffle board 14 and the orbiting scroll 2 separate the suction inlet 3 from the slide mechanism section. The vent hole 24 in the main shaft 6 acts to quickly discharge the gas from the oil cap 7 in operation, thereby increasing the pumping efficiency.

The lubricating structure in the compressor thus constructed will be described in detail with reference to FIG. 3. FIG. 3 is a sectional view showing a part of the structure around the upper end portion of the main shaft.

In FIG. 3, reference numeral 30 designates a first space defined by the lower end face 20*c* of the orbiting scroll shaft 2*c*, the orbiting scroll bearing 18, and the bottom 600*a* of the eccentric hole 60*a*. Reference numeral 31 designates a second space which is provided on the side of the inner periphery of the thrust bearing 21 and which is defined by the lower surface 20*b* of the base plate 2 of the orbiting scroll 2 and the upper end face 61*a* of the large-diameter part 6*a* of the main shaft 6. Reference numeral 32 designates a third space formed on the side of the outer periphery of the thrust bearing 21. Reference numeral 33 designates a first oil groove formed in the inner wall of the orbiting scroll bearing 18 and extending from a point near the upper end face to the lower end face of the orbiting scroll bearing 18. The lower end of the first oil groove 33 communicates with the first space 30. Reference numeral 34 designates a second oil groove which is on the side of the outer cylindrical surface 61*a* of the large-diameter part 6*a* of the main shaft 6 and which is formed in the sliding surface on the main shaft bearing 19. The upper end of the second oil groove 34 is communicated with the second space 31, and its lower end is located near the lower end of the main shaft bearing 19. Reference numeral 35 designates a second lubrication hole through which the first oil groove 33 is communicated with the second oil groove 34. Further, 21*a* designates a plurality of third oil grooves formed in the sliding surface of the thrust bearing on which the orbiting scroll 2 slides. The third oil grooves 21*a* communicate with the second space 31, while second ends are communicated through the third space 32 with the oil return hole 25.

As is apparent from the above description, the first lubrication hole 23, the first space 30, the first oil groove 33, the second lubrication hole 35, the second oil groove 34, the second space 31 and the third oil grooves 21 form a series of lubrication paths. The oil pumped by the centrifugal pumping action moves as indicated by the broken line arrows, and then passes to the oil return hole 25 through the third space 32. The remainder of the oil path is as described with reference to FIG. 2.

In the above-described lubricating structure, the lubrication paths are maintained filled with oil during the operation of the compressor. However, when the compressor is stopped, the oil flow by force of gravity in directions opposite to the directions of the broken line arrows in FIG. 3, finally returning to the oil pool 15 through the first lubrication hole 23, with the result that the lubrication paths are filled with gas. Accordingly, when, under this condition, the compressor is again started, the gas is discharged as indicated by the broken line arrows, and then the lubrication paths are filled with oil. Therefore, there is a lag time from the time the compressor is started until all sliding parts are lubricated.

In a scroll compressor in which the compressor section is at the top and the motor section is at the bottom, when, for instance, the compressor is started with refrigerant in the oil pool, the oil in the oil pool 15 may foam momentarily, rising to the upper portion of the housing 12 and not returning to the oil pool 15 immediately. That is, an oil shortage can occur momentarily in the compressor. Accordingly, the bearings and other sliding members can seize or be damaged.

SUMMARY OF THE INVENTION

Overcoming the disadvantages of the prior art, the invention provides a scroll compressor in which a weir is provided in an oil storage section formed in an upper end portion of the main shaft. Accordingly, a predetermined quantity of lubricating oil is held in the oil storage section when the compressor is stopped. When the compressor is started, lubricating oil from the bottom of the compressor housing is supplied through the lubrication hole formed in the main shaft into the oil storage section so that the oil in the oil storage section is supplied to the bearings.

DESCRIPTION OF THE PREFERRED EMBODIMENTS

Figure 4:
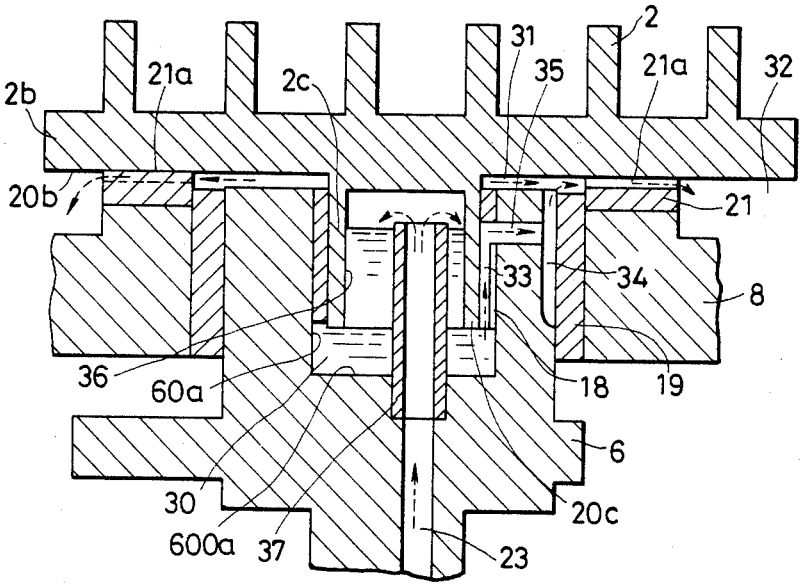
FIG. 4 is a sectional view showing part of essential components of a centrifugal lubricating structure in a scroll compressor of the invention.

A preferred embodiment of the invention will be described with reference to FIG. 4. FIG. 4 is a sectional view showing essential components of a lubricating structure around the upper portion of the main shaft.

In FIG. 4, reference numeral 36 designates an oil storing hole formed in the orbiting scroll shaft 2*c*, the storing hole 36 opening in the lower end face 20*c* of the orbiting scroll shaft 2*c* and being formed coaxially with the latter. The oil storing hole 36 communicates with the first space 30. Reference numeral 37 designates a pipe having one end connected to the end of the lubrication hole 23, for instance, by press fitting. The other end of the pipe 37 extends to a predetermined level in the oil storing hole 36. The inside diameter of the pipe 37 is equal to that of the lubrication hole 23. The other components are the same as those of the conventional scroll compressor.

Figure 1A:
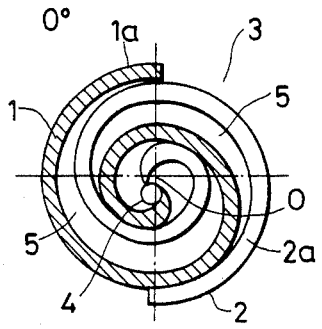
FIG. 1A PRIOR ART
FIGS. 1A to 1A are diagrams used for a description of the operating principles of a scroll compressor.
Figure 1D:
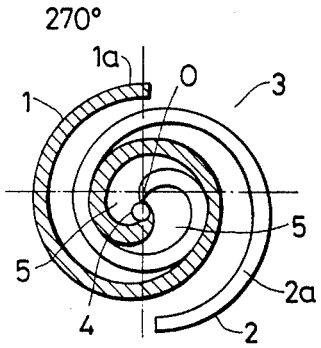
FIG. 1D PRIOR ART
Figure 1B:
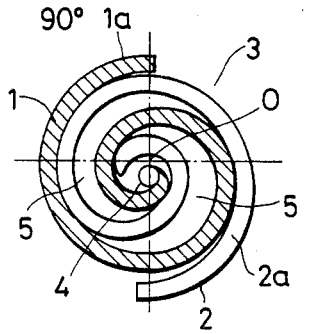
FIG. 1B PRIOR ART
Figure 1C:
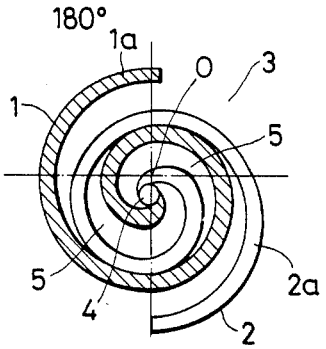
FIG. 1C PRIOR ART
Figure 2:
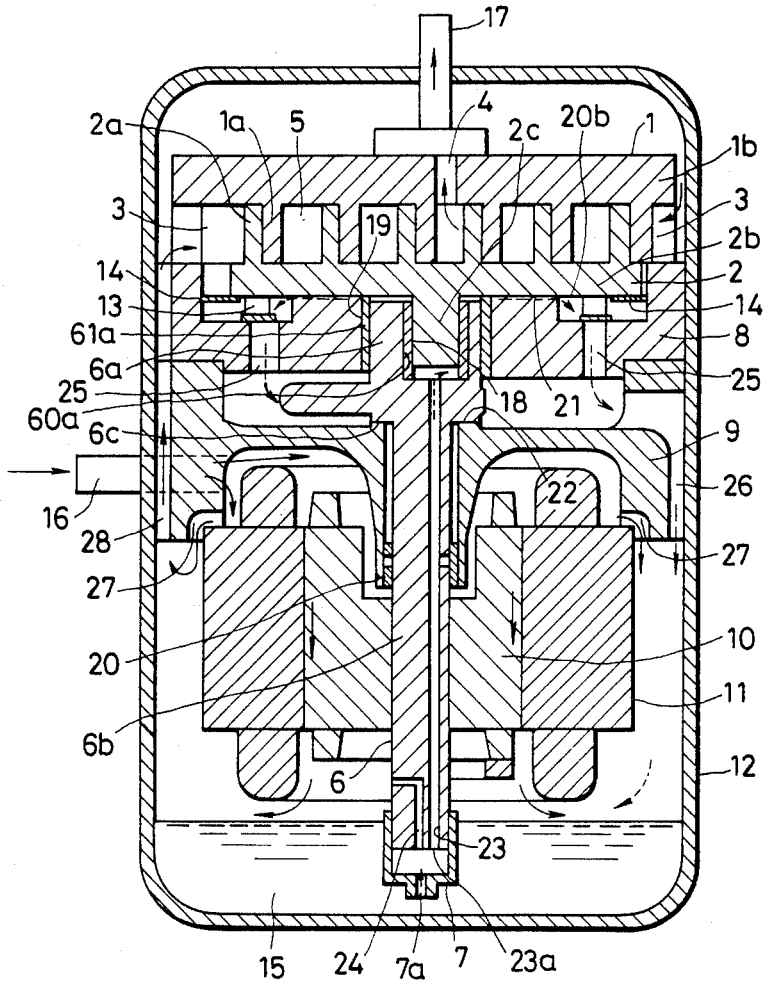
FIG. 2 PRIOR ART
FIG. 2 is a sectional view of a conventional scroll compressor.
Figure 3:
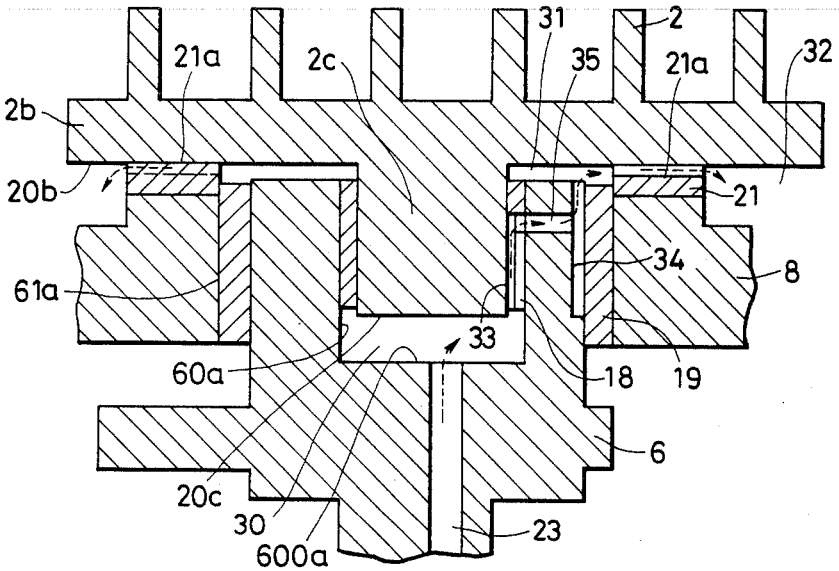
FIG. 3 PRIOR ART
FIG. 3 is a sectional view showing parts of essential components of a centrifugal lubricating structure in the conventional compressor.

In the scroll compressor thus constructed, when the main shaft 6 is driven, the oil in the oil pool 15 is delivered through the suction hole 7*a* of the oil cap 7 to the first lubrication hole 23 as indicated by the broken line arrow in FIG. 2, then passes from the first lubrication hole 2 to the pipe 37 as indicated by the broken line arrow in FIG. 4. Then, the oil flows from the pipe 37 to an oil storage section provided by the oil storing hole 36 and the first space 30 where it is stored. After filling the oil storage section, the oil is delivered through the first oil groove 33, the second lubrication hole 35, the second oil groove 34, the second space 31 and the third oil grooves 21*a* while lubricating the bearings 18, 19 and 21, and is then returned to the oil pool 15 as in the conventional scroll compressor.

In the scroll compressor of the invention, the oil storage section is formed by utilization of the large-diameter part 61*a* of the main shaft 6 and the orbiting scroll shaft 2*c*. Therefore, the oil storage section is compact but large in volume. Since the pipe 37 protrudes into the oil storing hole 36, when the compressor is stopped, due to the presence of the pipe 37, the oil is stored in the oil storage section to the height of the pipe 37. In the case where, as shown in FIG. 4, the top of the pipe 37 is substantially at the same level as the second lubrication hole 35, the lubrication paths, except for those in the first lubrication hole 23 and the pipe 37, remain substantially filled with oil when the compressor is stopped. Accordingly, when the compressor is started again, because the space occupied by the gas is small, the starting response of lubrication for the bearings 18, 19 and 21 is greatly improved. Even if, at the start of the compressor, refrigerant in the oil pool 15 is caused to foam thus causing a momentary oil shortage, because a predetermined amount of oil is held in the lubrication paths including the oil storage section and is supplied to the bearings 18, 19 and 21, seizure of the latter is prevented.

In the above-described embodiment, the top of the pipe 37 is substantially at the same level as the second lubrication hole 35. However, if the depth of the oil storing hole 36 is increased and the height of the pipe 37 is increased to the level of the third oil grooves 21*a*, lubrication will be performed even more satisfactorily because the oil storage section and the lubrication paths downstream thereof remain filled with oil. The same effect can be obtained by modifying the main shaft by eliminating the pipe 37 and instead forming the wall of the lubrication hole so as to protrude into the oil storing hole 36.

As is apparent from the above description, in the scroll compressor according to the invention, a weir is provided in the oil storage section formed in the upper end portion of the main shaft so that a predetermined quantity of oil is held in the oil storage section, and lubricating oil from the bottom of the housing is supplied through the lubrication hole formed in the main shaft into the oil storage section so that oil from the oil storage section is supplied to the bearings. Therefore, when the scroll compressor is started, lubricating oil from the oil storage section is supplied to the bearings, resulting in improved starting lubrication and prevention of seizure of the main shaft bearings. Furthermore, since the oil storage section is provided in the upper end portion of the main shaft, lubrication of the bearings is improved without changing the size of the compressor.

We claim:

1. A scroll compressor comprising:

a stationary scroll and an orbiting scroll having respective spiral wraps assembled to form compression chambers therebetween, said orbiting scroll having a drive shaft;

a main shaft for driving said orbiting scroll to compress fluid in said compression chambers, an oil storage section being formed by a hole in an upper end portion of said main shaft and a hole in a lower portion of said drive shaft of said orbiting scroll, and a lubrication hole being formed in said main shaft, said lubrication hole having a lower end opening in a lower end of said main shaft and an upper end communicated with said oil storage section so that lubricating oil flowing into said lubrication hole through said lower end when said main shaft is driven is delivered through said lubrication hole to the oil storage section;

bearing means interposed between said main shaft and said drive shaft of said orbiting scroll and receiving lubricating oil from said oil storage section;

an electric motor for driving said main shaft;

a housing having an oil pool in a bottom portion thereof and accommodating said stationary scroll, said orbiting scroll, said motor and said main shaft with said stationary scroll and said orbiting scroll at an upper portion of said housing and said motor at a lower portion of said housing, and a lower end portion of said main shaft being immersed in lubricating oil in said oil pool; and a weir for storing a predetermined quantity of lubricating oil in said oil storage section;

said bearing extending from a first axial position to a second axial position in said main shaft and said weir maintaining a level of oil therein to a position intermediate said bearing positions when the compressor is stopped.

2. The scroll compressor as claimed in claim 1, in which said weir is a pipe having a predetermined height and which protrudes into said oil storage section, one end of said pipe being connected to said lubrication hole and the other end of said pipe opening into said oil storage section.

3. The scroll compressor as claimed in claim 2, wherein an air space is provided around an upper portion of said pipe.

4. The scroll compressor as claimed in claim 1, wherein said bearing means has a groove extending therealong in a direction parallel to a longitudinal axis of said main shaft, a lower end of said groove opening at said oil storage section, and an upper end of said groove communicating with a lubricating space formed around an upper end of said upper end portion of said main shaft.

5. The scroll compressor as claimed in claim 4, wherein an upper end of said pipe is at substantially the same level as said upper end of said groove.

6. The scroll compressor of claim 2, wherein said one end of said pipe is press fitted into a hole in said main shaft formed coaxially with said lubrication hole.

7. The scroll compressor as claimed in claim 6, wherein an inside diameter of said pipe is substantially equal to a diameter of said lubrication hole.

8. The scroll compressor as claimed in claim 1, wherein said hole in said drive shaft of said orbiting scroll is substantially coaxial therewith.

9. The scroll compressor as claimed in claim 1 which further includes an orbiting scroll (2) having a wrap on one side of a base plate and an orbiting scroll shaft (2*c*) on the other side of the base plate; a stationary scroll (1) that has a wrap on one side of a base plate which, when combined with the wrap of the orbiting scroll (2), forms refrigerant gas compression chambers between said two wraps; a main shaft (19) for driving said orbiting scroll (2) which has at one of its end faces a large-diameter part (6*a*) provided with an eccentric hole (60*a*) for supporting the cylindrical wall of said orbiting scroll shaft (2*c*); a main shaft bearing (19) for supporting the cylindrical wall of said large-diameter part (6a); a bearing frame (8) for supporting said main shaft bearing (19) that is provided under said orbiting scroll (2) in a face-to-face relationship with the base plate of said orbiting scroll; electric motors (10) and (11) for driving said main shaft (6); a housing (12) having an oil pool (15) in the bottom which accommodates said orbiting scroll (2) and said stationary scroll (1) atop said bearing frame (8) and said electric motors (10) and (11) beneath said bearing frame (8), with the lower end portion of said main shaft (6) being immersed in said oil pool (15); a first lubricating hole (23) formed in said main shaft (6) which has a lower open end submerged in said oil pool (15) and has an upper end communicating with a first space (30) via said oil storage section (36), said first space (30) being formed between the bottom of said eccentric hole (60a) and the lower end of said orbiting scroll shaft (2c); a first lubricating groove (33) which extends vertically and is provided in either the outer wall of the orbiting scross shaft (2c) or the supporting face of said eccentric hole (60a) or both, the lower end portion of said first lubricating groove (33) communicating with said first space (30); a second lubricating groove (34) which extends vertically and is provided in either the outer cylindrical wall of said large-diameter part (6a) or the supporting face of said main shaft bearing (19) or both, the upper end portion of said second lubricating groove (34) communicating with a second space (31) formed between the upper end face of said main shaft bearing (19) and the underside of the base plate of said orbiting scroll (2); a second lubricating hole (35) that passes through said large-diameter part (6a) and by which said first lubricating groove (33) communicates with said second lubricating groove (34); an oil channel (21a) that is formed between said orbiting scroll (2) and said bearing frame (8) and which communicates with said second space (31); and oil return channels (25) and (26) extending across and below said bearing frame (8), the centrifugal force created by the rotation of said main shaft (6) causes a lubricating oil in said oil pool (15) to circulate through the system comprising said first lubricating hole (23), said oil storage section (36), said first space (30), said first lubricating groove (33), said second lubricating hole (35), said second lubricating groove (34), said oil channel (21a), said oil return channels (25) and (26), and said oil pool (15).

10. The scroll compressor as claimed in claim 9, wherein said first lubricating groove (33) extends in a direction crossing the direction in which the orbiting scroll shaft (2c) rotates relative to the orbiting scroll bearing (18), said second lubricating groove (34) extending in a direction crossing the rotational direction of the large-diameter part (6a) of the main shaft (6).

11. The scroll compressor as claimed in claim 9, wherein said second lubricating hole (35) is positioned intermediate between the top and bottom of the orbiting scroll bearing (18).

12. The scroll compressor as claimed in any one of claims 9 to 11, wherein said lubricating groove (34) is closed at a position beneath the second lubricating hole (35).

13. The scroll compressor as claimed in any one of claims 9 to 11, wherein the oil channel (21a) communicating with the second space (31) consists of a plurality of grooves provided radially in a thrust bearing (21) formed on top of said bearing frame (8).

14. The scroll compressor as claimed in claim 13, wherein a compartment accommodating a mechanism (13) for preventing the rotation of the orbiting scroll (2) is formed in the bearing frame (8) at a position radially outward of the thrust bearing (21), the lubricating oil passing through the oil channel (21a) in the thrust bearing (21) is caused to flow into the return channels (25) and (26) through said rotation preventing mechanism accomodating compartment.

15. The scroll compressor as claimed in claim 1 which further includes an orbiting scroll (2) having a wrap on one side of a base plate and an orbiting scroll shaft (2c) on the other side of the base plate; a stationary scroll (1) that has a wrap on one side of the base plate which, when combined with the wrap of the orbiting scroll (2), forms refrigerant gas compression chambers between said two wraps; a main shaft (19) for driving said orbiting scroll (2) which has at one of its end faces a large-diameter part (6a) provided with an eccentric hole (60a) for supporting the cylindrical wall of said orbiting scroll shaft (2c); a main shaft bearing (19) for supporting the cylindrical wall of said large-diameter part (6a); a bearing frame (8) for supporting said main shaft bearing (19) that is provided under said orbiting scroll (2) in a face-to-face relationship with the base plate of said orbiting scroll; a thrust bearing (21) that is provided on top of said bearing frame (8) for supporting said orbiting scroll; electric motors (10) and (11) for driving said main shaft (6); a housing (12) having an oil pool (15) in the bottom which accomodates said orbiting scroll (2) and said stationary scroll (1) atop said bearing frame (8) and said electric motors (10) and (11) beneath said bearing frame (8), with the lower end portion of said main shaft (6) being immersed in said oil pool (15); a first lubricating hole (23) formed in said main shaft (6) which has a lower open end submerged in said oil pool (15) and has an upper end communicating with a first space (30) via said oil storage section (36), said first space (30) being formed between the bottom of said eccentric hole (60a) and the lower end of said orbiting scroll shaft (2c); a first lubricating groove (33) which extends vertically and is provided in either the outer wall of the orbiting scroll shaft (2c) or the supporing face of said eccentric hole (60a) or both, the lower end portion of said first lubricating groove (33) communicating with said first space (30) and the upper end portion being closed in the neighborhood of the lower end of said main shaft bearing (19); a second lubricating groove (34) which extends vertically and is provided in either the outer cylindrical wall of said large-diameter part (6a) or the supporting face of said main shaft bearing (19) or both, the lower end portion of said second lubricating groove (34) being closed in the neighborhood of said main shaft bearing (19), and the upper end portion communicating with a second space (31) formed between the upper end face of said main shaft bearing (19) and the underside of the base plate of said orbiting scroll (2); a second lubricating hole (35) that passes through said large-diameter part (6a) and by which said first lubricating groove (33) communicates with said second lubricating groove (34); a third lubricating groove (21a) that is provided radially extensively in the bearing surface of said thrust bearing (21), the radial inner end of said groove communicating with said second space (31); and oil return channels (25) and (26) extending across and below said bearing frame (8), the centrifugal force created by the rotation of said main shaft (6) causes a lubricating oil in said oil pool (15) to circulate through the system comprising said first lubricating hole (23), said oil storage section (36), said first space (30), said first lubricating groove (33), said second lubricating hole (35), said second lubricating groove (34), said third lubricating groove (21*a*), said oil return channels (25) and (26), and said oil pool (15).

16. The scroll compressor as claimed in claim 15, wherein said first lubricating groove (33) extends in a direction crossing the direction in which the orbiting scroll shaft (2*c*) rotates relative to the orbiting scroll bearing (18), said second lubricating groove (34) extending in a direction crossing the rotational direction of the large-diameter part (6*a*) of the main shaft (6).

17. The scroll compressor as claimed in claim 15, wherein said second lubricating hole (35) is positioned above the point intermediate between the top and bottom of the orbiting scroll bearing (18).

18. The scroll compressor as claimed in any one of claims 15 to 17, wherein a compartment accommodating a mechanism (13) for preventing the rotation of the orbiting scroll (2) is formed in the bearing frame (8) at a position radially outward of the thrust bearing (21), the lubricating oil passing through the third lubricating groove (21*a*) in the thrust bearing (21) is caused to flow into the return channels (25) and (26) through said rotation preventing mechanism accommodating compartment.

19. The scroll compressor as claimed in claim 1 which further includes a sealed housing (12) having an oil pool (15) in the bottom; a bearing frame (8) provided within said housing (12); a stationary scroll (1) provided in said housing (12) which is mounted atop said bearing frame (8) and has a wrap facing said bearing frame (8); an orbinting scroll (2) provided in said housing (12) which is positioned between said stationary scroll (1) and said bearing frame (8), said orbiting scroll (2) having a wrap facing said stationary scroll (1) which, when combined with the wrap on said stationary scroll (1), forms refrigerant gas compressor chambers (5); a main shaft (6) that vertically penetrates said bearing frame (8) and which is supported by said bearing frame (8), the top end of said main shaft (6) being coupled to said orbiting scroll (2) and the bottom end thereof being immersed in an oil in said oil pool (15); electric motors (10) and (11) which are provided between said bearing frame (8) and said oil pool (15) and drive said main shaft (6) to rotate; a rotation preventing mechanism (13) which, when said motors (10) and (11) transmit a rotational force to said orbiting scroll (2) via said main shaft, suppresses the rotation of said orbiting scroll (2) and allows only the orbiting movement thereof; a first centrifugal pump (23) which by the action of the centrifugal force created on said main shaft (6) during its rotation, sucks the oil (15*a*) in said oil pool (15) so that it is lifted to the top of said main shaft (6) and supplied into said oil storage section (36); second centrifugal pumps (30) and (33) which, by the action of the centrifugal force created on said main shaft (6) during its rotation, pump up the oil that has been supplied from said first centrifugal pump (23) into said oil storage section (36); and third centrifugal pumps (35) and (34) which, by the action of the centrifugal force created on said main shaft (6) during its rotation, supply the oil pumped up by said second centrifugal pumps (30) and (33) into that portion of the main shaft (6) which slides against said bearing frame (8).

20. The scroll compressor as claimed in claim 19, wherein the first to third centrifugal pumps (23), (30), (33), (35) and (34), as well as the oil storage section (36) are connected in series so as to make a continuous lubrication path.

21. The scroll compressor as claimed in claim 19 or 20, wherein the second centrifugal pumps (30) and (33) are positioned radially outwardly of the first centrifugal pump (23) whereas the third centrifugal pumps (35) and (34) are positioned radially more outward than said second centrifugal pumps (30) and (33).

22. The scroll compressor as claimed in claim 1 which further includes a sealed housing (12) having an oil pool (15) in the bottom; a bearing frame (8) provided within said housing (12); a stationary scroll (1) provided in said housing (12) which is mounted atop said bearing frame (8) and has a wrap facing said bearing frame (8); an orbiting scroll (2) provided in said housing (12) which is positioned between said stationary scroll (1) and said bearing frame (8), said orbiting scroll (2) having a wrap facing said stationary scroll (1) which, when combined with the wrap on said stationary scroll (1), forms refrigerant gas compressor chambers (5); a main shaft (6) that vertically penetrates said bearing frame (8) and which is supported by said bearing frame (8), the top end of said main shaft (6) being coupled to said orbiting scroll (2) and the bottom end thereof being immersed in an oil in said oil pool (15); electric motors (10) and (11) which are provided between said bearing frame (8) and said oil pool (15) and drive said main shaft (6) to rotate; a rotation preventing mechanism (13) which, when said motors (10) and (11) transmit a rotational force to said orbiting scroll (2) via said main shaft, suppresses the rotation of said orbiting scroll (2) and allows only the orbiting movement thereof; a first centrifugal pump (23) which, by the action of the centrifugal force created on said main shaft (6) during its rotation, sucks the oil (15*a*) in said pool (15) so that it is lifted to the top of said main shaft (6) and supplied into said oil storage section (36); second centrifugal pumps (30) and (33) which, by the action of the centrifugal force created on said main shaft (6) during its rotation, pump up the oil that has been supplied from said first centrifugal pump (23) into said oil storage section (36); and third centrifugal pumps (35) and (34) which, by the action of the centrifugal force created on said main shaft (6) during its rotation, supply the oil pumped up by said second centrifugal pumps (30) and (33) into said rotation preventing mechanism (13) via the oil channel (21*a*) between said orbiting scroll (2) and said bearing frame (8).

23. The scroll compressor as claimed in claim 22, wherein the first to third centrifugal pumps (23), (30), (33) (35) and (34), as well as the oil storage section (36) are connected in series so as to make a continuous lubrication path.

24. The scroll compressor as claimed in claim 22 or 23, wherein the second centrifugal pumps (30) and (33) are positioned radially outwardly of the first centrifugal pump (23) whereas the third centrifugal pumps (35) and (34) are positioned radially more outward than said second centrifugal pumps (30) and (33).

* * * * *